US007585161B2

(12) United States Patent
Noh et al.

(10) Patent No.: US 7,585,161 B2
(45) Date of Patent: Sep. 8, 2009

(54) COMPRESSOR

(75) Inventors: Ki Won Noh, Seoul (KR); Yong Hwan Eom, Seoul (KR)

(73) Assignee: LG Electronics Inc., Seoul (KR)

( * ) Notice: Subject to any disclaimer, the term of this patent is extended or adjusted under 35 U.S.C. 154(b) by 590 days.

(21) Appl. No.: 11/191,904

(22) Filed: Jul. 29, 2005

(65) Prior Publication Data

US 2006/0093497 A1 May 4, 2006

(30) Foreign Application Priority Data

Nov. 2, 2004 (KR) ..... 10-2004-0088262

(51) Int. Cl.
*F04B 11/00* (2006.01)

(52) U.S. Cl. ..... 417/540; 417/312

(58) Field of Classification Search ..... 417/312, 417/363, 540, 902

See application file for complete search history.

(56) References Cited

U.S. PATENT DOCUMENTS 4,108,581 A * 8/1978 Miller et al. ..... 417/363
4,854,416 A * 8/1989 Lalikos et al. ..... 181/207
4,973,230 A * 11/1990 Da Costa ..... 417/312
5,339,652 A * 8/1994 Dreiman ..... 62/296
6,537,041 B2 * 3/2003 Lee ..... 417/415
2002/0009370 A1 * 1/2002 Kueon ..... 417/63
2005/0142014 A1 * 6/2005 Jung et al. ..... 417/540

FOREIGN PATENT DOCUMENTS

KR 20020072738 9/2002

* cited by examiner

*Primary Examiner*—Devon C Kramer
*Assistant Examiner*—Nathan Zollinger
(74) *Attorney, Agent, or Firm*—Birch, Stewart, Kolasch & Birch, LLP

(57) ABSTRACT

Disclosed herein is a compressor in which a coil weight is wound plural times on a highly vibrational portion of a discharge pipe to increase the mass of the highly vibrational portion, thereby enabling a vibrating frequency of the discharge pipe to be adjusted to a desired value. With this configuration, there is no need to coil up the discharge pipe plural times differently from the prior art. Thereby, the compressor exhibits an effective interior space utility, minimized malfunction rate, and low manufacturing costs.

10 Claims, 5 Drawing Sheets

COMPRESSOR

BACKGROUND OF THE INVENTION

1. Field of the Invention

The present invention relates to a compressor to compress gas, such as refrigerant gas, and, more particularly, to a compressor in which a coil weight is wound plural times on a highly vibrational portion of a discharge pipe that is used to discharge compressed gas.

2. Description of the Related Art

Generally, compressors are mechanical apparatuses to compress gas, such as refrigerant gas, to thereby raise a pressure thereof. Compressors may be generally classified into dynamic compressors and positive displacement compressors.

Considering first dynamic compressors, they are configured to raise a pressure of gas using momentum caused by a high flow rate of the gas obtained when a rotor is rotated at very high speed. The dynamic compressors are mainly used in need of a high flow rate.

Such dynamic compressors may be sub-classified into centrifugal compressors and axial flow compressors, and vary in size and application from large-scale industrial compressors and gas turbine engine compressors to car turbo charger compressors. In addition, there are various different shapes of compressors, such as a screw compressor that is designed to compress gas inside a space defined by two screws using a rotating force thereof, and a scroll compressor that is designed to compress gas between two spiral grooves using a rotating force thereof.

A representative example of displacement compressors is a reciprocating piston type compressor, such as a linear compressor. This kind of compressor has a cycle of suctioning and compressing air according to reciprocating movement of a piston inside a cylinder as well as opening and closing operations of a valve to thereby discharge the compressed air. The displacement compressors are mainly used in need of a high pressure.

FIG. 1 is a perspective view illustrating an example of a conventional compressor having an open top side. FIG. 2 is an enlarged sectional view of a loop pipe shown in FIG. 1.

As shown in FIG. 1, the conventional compressor includes a shell 2, a compression unit 10 mounted in the shell 2 in a shock-absorbing manner and adapted to suction and compress fluid, such as refrigerant gas (hereinafter referred to as "fluid"), to thereby discharge the compressed fluid, and a loop pipe 20 connected to a discharge side of the compression unit 10 to discharge the compressed fluid from the compression unit 10 to the outside. The loop pipe 20 also serves to attenuate vibration generated in the compression unit 10.

The shell 2 includes a lower shell 3 having an open top surface, and an upper shell 4 configured to cover the top surface of the lower shell 3.

A suction pipe 5 is penetrated through one side of the shell 2 to introduce fluid into the shell 2.

The loop pipe 20 is also penetrated through the other side of the shell 2.

As shown in FIG. 2, the loop pipe 20 includes a discharge pipe 22 to guide the compressed fluid from the compression unit 10 to be discharged to the outside, and a coil weight 24 wound on an outer circumference of the discharge pipe 22.

Highly vibrational portions 26 and 28 of the loop pipe 20, which show a larger vibration degree than the remaining portion of the loop pipe 20, are coiled up at least two times. Coiling up a portion of the loop pipe 20 has the effect of increasing the mass of the coiled portion, thereby achieving a reduced rigidity and minimized vibration transmission to the outside.

However, the conventional compressor has a problem in that the loop pipe 20 requires a relatively wide installation space because the highly vibration portions 26 and 28 thereof are coiled up at least two times. If the coiled portion of the loop pipe 20 is interfered with the shell 2, it may cause operational malfunction of the compressor. Further, coiling up the loop pipe 20 at least two times requires an additional process, resulting in low workability and increased manufacturing costs.

SUMMARY OF THE INVENTION

Therefore, the present invention has been made in view of the above problems, and it is an object of the present invention to provide a compressor which can achieve effective interior space utility, minimized malfunction rate, and low manufacturing costs.

In accordance with a first aspect of the present invention, the above and other objects can be accomplished by the provision of a compressor comprising: a shell; a compression unit mounted in the shell in a vibrational manner to compress fluid; a discharge pipe connected to the compression unit to discharge the compressed fluid from the compression unit; and a coil weight wound on the discharge pipe, wherein the coil weight is wound plural times on a portion of the discharge pipe located at a plane perpendicular to a vibrating direction of the compression unit.

Preferably, the shell may be formed with a suction pipe through-hole for the penetration of a fluid suction pipe, and a discharge pipe through-hole for the penetration of the discharge pipe.

Preferably, the shell may include: a lower shell; and an upper shell configured to cover an upper side of the lower shell to thereby define a hermetic space along with the lower shell.

Preferably, a rear portion of the compression unit may be disposed on a first damper mounted in a front region of the shell, and a front portion of the compression unit may be disposed on a second damper mounted in a rear region of the shell, whereby the compression unit is mounted in the shell in a shock-absorbing manner.

Preferably, the compression unit may include: a cylinder block centrally provided with a cylinder; a back cover having a suction pipe; a piston disposed to linearly reciprocate into the cylinder and internally defining a suction channel; a suction valve to open or close the suction channel; a discharge valve assembly mounted to define a compression chamber between the piston and the discharge valve assembly and adapted to discharge fluid from the compression chamber into the discharge pipe if the fluid is compressed inside the compression chamber beyond a predetermined pressure; a linear motor adapted to generate a driving force for linearly reciprocating the piston into the cylinder; a motor cover coupled to a side of the linear motor; and a spring support configured to support a first spring interposed between a back cover and the spring support and a second spring interposed between the motor cover and the spring support.

Preferably, the linear motor may include: an outer stator core coupled to the cylinder block; a bobbin mounted in the outer stator core; a coil wound around the bobbin; an inner stator core coupled to the cylinder block to be spaced apart from the outer stator core to define a predetermined gap therebetween; a magnet located between the outer stator core and the inner stator core to linearly reciprocate using a magnetic force generated around the coil; and a magnet frame configured to support the magnet mounted thereon and coupled to the piston to transmit linear movement force of the magnet to the piston.

Preferably, the portion of the discharge pipe, located at the plane perpendicular to the vibrating direction of the compression unit, may be bent by an angle smaller than 360°.

Preferably, the coil weight may be wound one time on the remaining portion of the discharge pipe except for the portion of the discharge pipe located at the plane perpendicular to the vibrating direction of the compression unit.

In accordance with a second aspect of the present invention, the above and other objects can be accomplished by the provision of a compressor comprising: a shell; a compression unit mounted in the shell in a vibrational manner to compress fluid; a discharge pipe connected to the compression unit to discharge the compressed fluid from the compression unit; and a coil weight wound on the discharge pipe, wherein the coil weight is wound plural times on a highly vibrational portion of the discharge pipe.

Preferably, the highly vibrational portion of the discharge pipe may be bent by an angle smaller than 360°.

With the compressor of the present invention configured as stated above, the coil weight is wound plural times on the highly vibrational portion of the discharge pipe to increase the mass of the highly vibrational portion. Thereby, it is possible to adjust a vibrating frequency of the discharge pipe to a desired value. Further, since there is no need to coil up the discharge pipe plural times differently from the prior art, the compressor exhibits an effective interior space utility, minimized malfunction rate, and low manufacturing costs.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Now, a preferred embodiment of the present invention will be explained with reference to the accompanying drawings.

Figure 1:
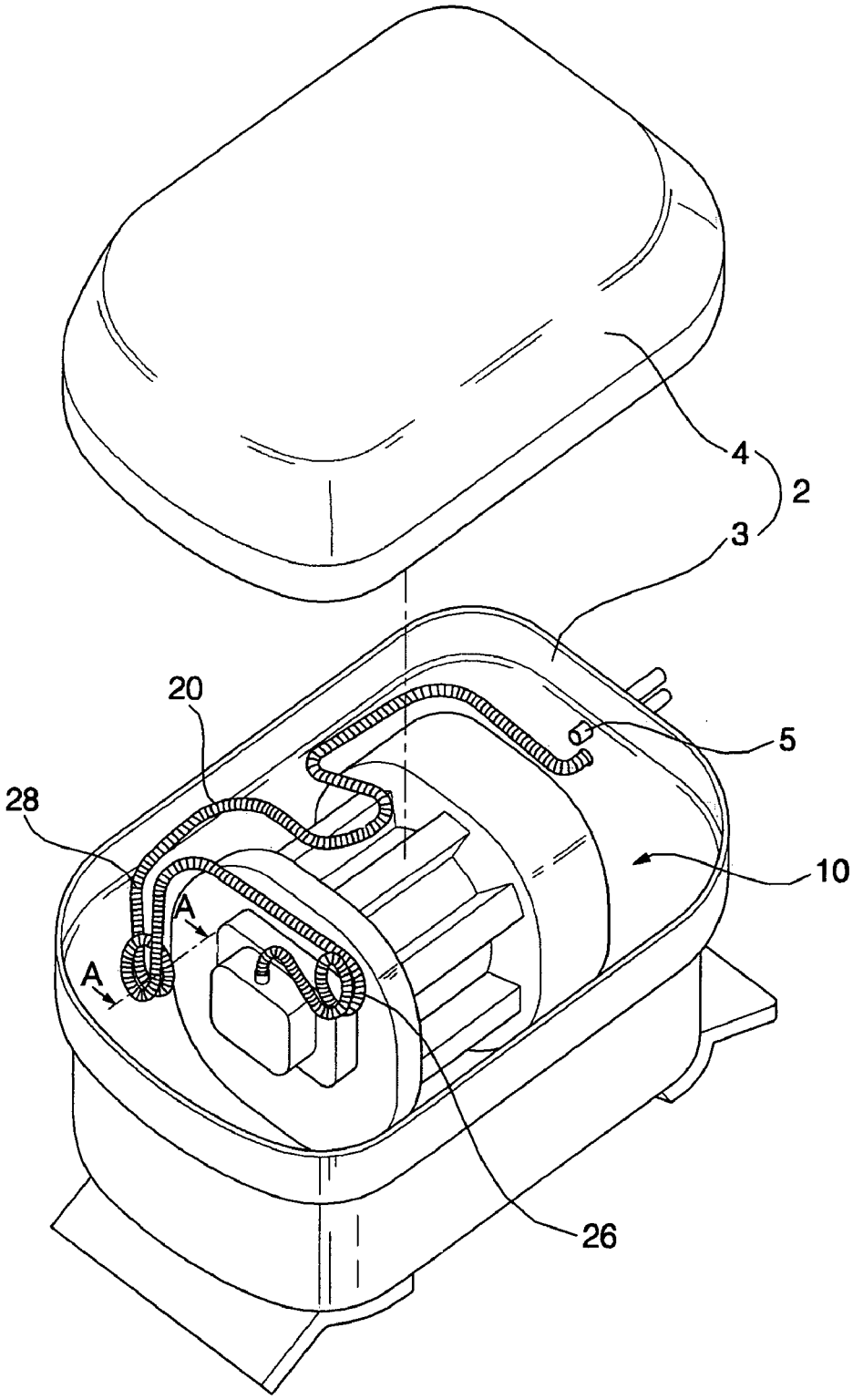
FIG. 1 (Prior Art)
FIG. 1 is a perspective view illustrating an example of a conventional compressor having an open top side.
Figure 2:
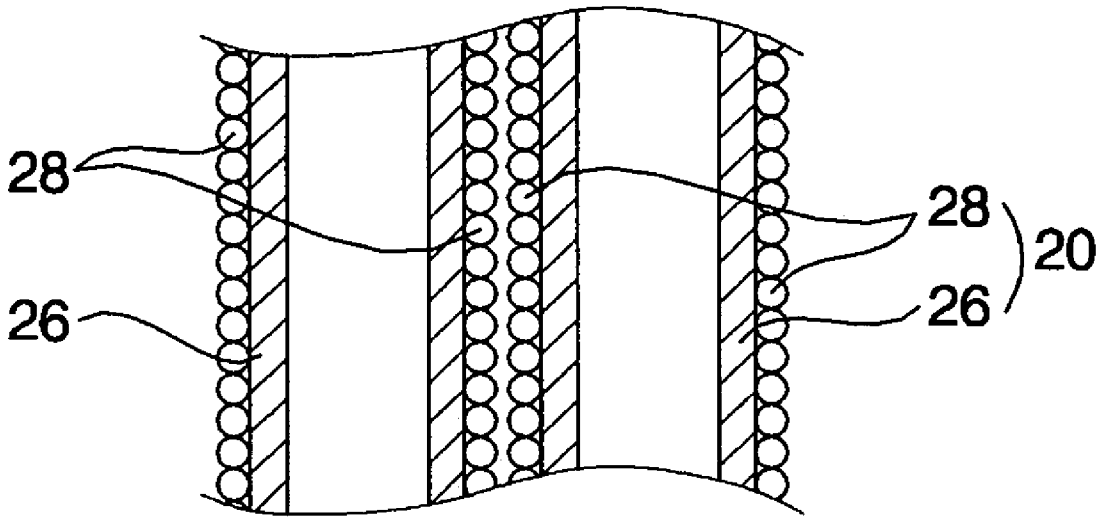
FIG. 2 (Prior Art)
FIG. 2 is an enlarged sectional view taken along the line A-A shown in FIG. 1.
Figure 3:
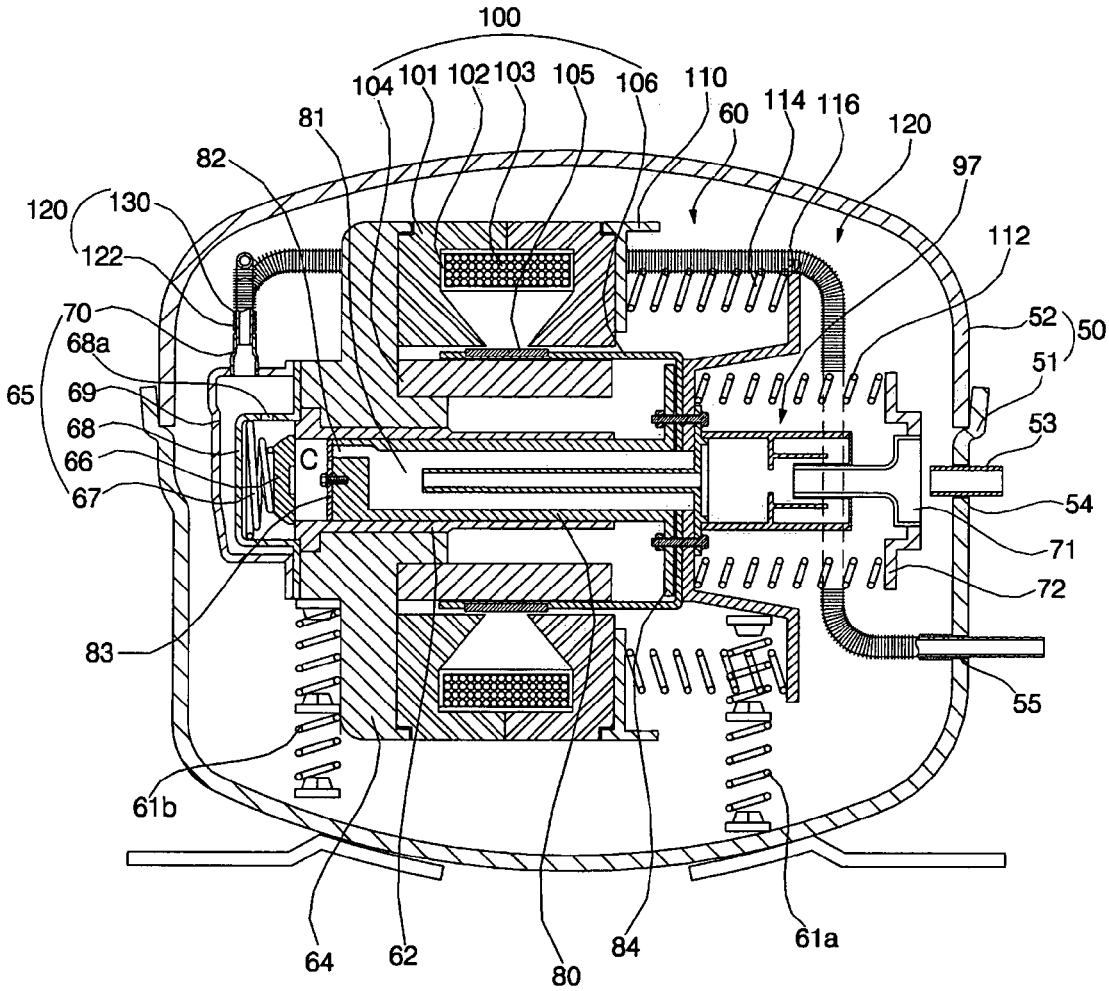
FIG. 3 is a sectional view illustrating the interior configuration of a compressor according to an embodiment of the present invention.
Figure 4:
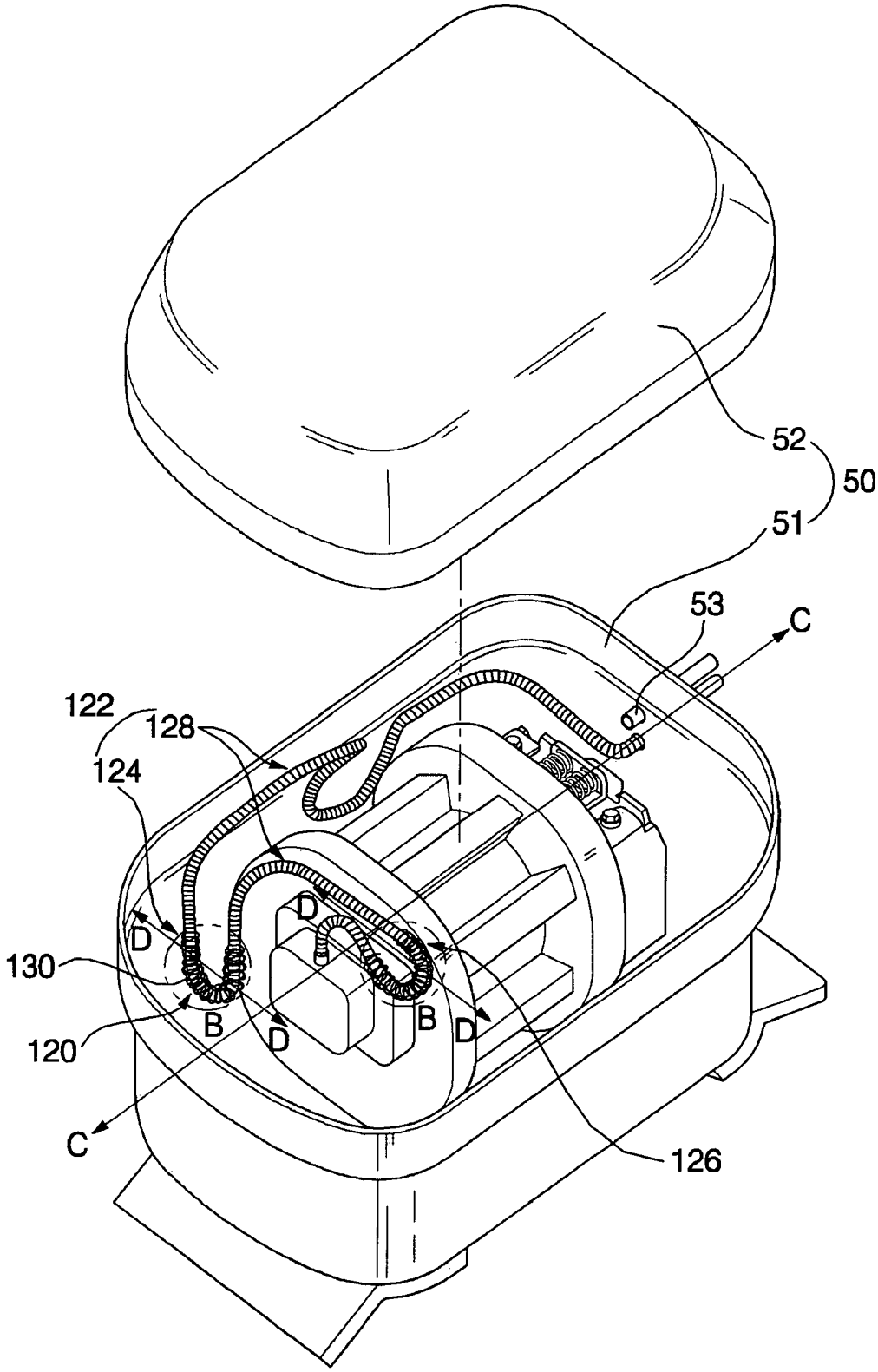
FIG. 4 is a perspective view of the compressor of FIG. 3 having an open top side.
Figure 5:
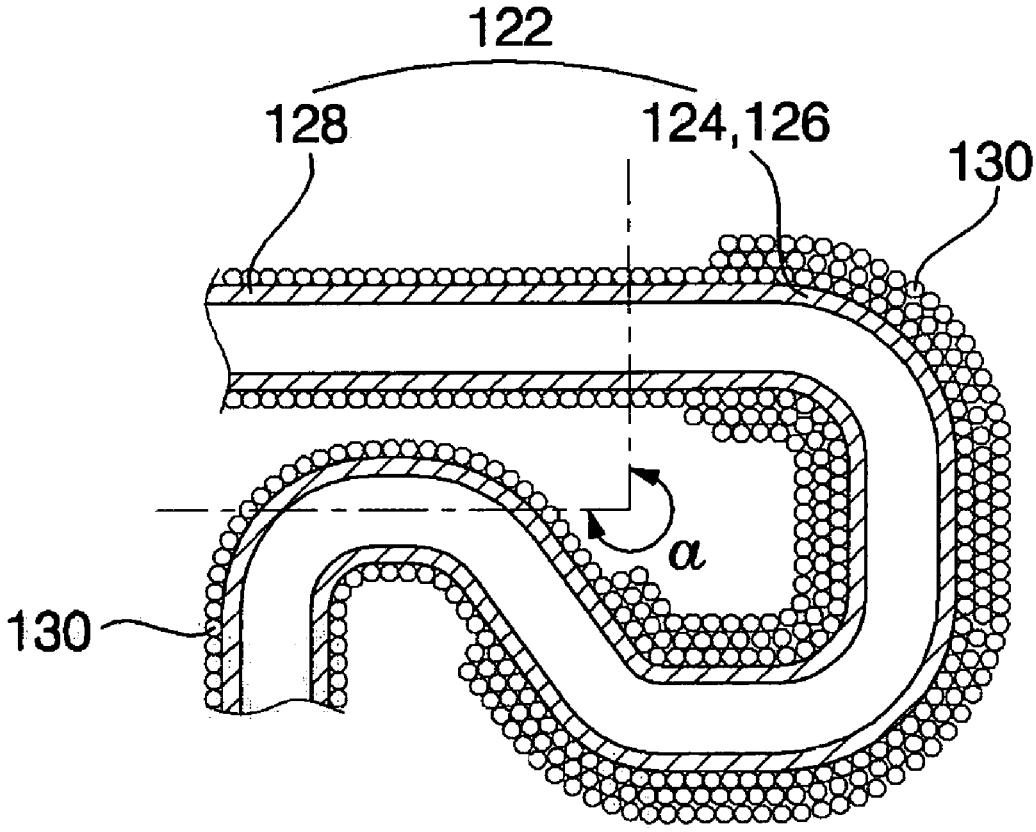
FIG. 5 is an enlarged sectional view of the circle B shown in FIG. 4.

FIG. 3 is a sectional view illustrating the interior configuration of a compressor according to an embodiment of the present invention. FIG. 4 is a perspective view of the compressor of FIG. 3 having an open top side. FIG. 5 is an enlarged sectional view of the circle B shown in FIG. 4.

As shown in FIGS. 3 and 4, the compressor according to an embodiment of the present invention includes a shell 50, and a compression unit 60 mounted in the shell 50 in a vibrational manner.

The shell 50 includes a lower shell 51, and an upper shell 52 configured to cover an upper side of the lower shell 51. Both the lower and upper shells 51 and 52 internally define a hermetic space. A suction pipe 53 is penetrated through the shell 50 to introduce fluid, such as refrigerant gas (hereinafter referred to as "fluid") into the shell 50.

The compression unit 60 is mounted in the shell 50 in a shock-absorbing manner. For this, a rear portion of the compression unit 60 is disposed on a first damper 61*a* mounted in the shell 50, and a front portion of the compression unit 60 is disposed on a second damper 61*b*.

The compression unit 60 includes a cylinder block 64 centrally provided with a cylinder 62, a back cover 72 having a suction pipe 71, a piston 80 disposed to linearly reciprocate into the cylinder 62, and a linear motor 100 adapted to generate a driving force for linearly reciprocating the piston 80 inside the cylinder 62.

A discharge valve assembly 65 is mounted at a front end of the cylinder 62 to define a compression chamber C between the front end of the cylinder 62 and the piston 80. If fluid inside the compression chamber C is compressed beyond a predetermined pressure, the compressed fluid is discharged into a loop pipe via the discharge valve assembly 65.

The discharge valve assembly 65 includes a discharge valve 66 to open or close the front end of the cylinder 62, an inner discharge cover 68 having a fluid discharge hole 68*a* formed at one side thereof, a discharge spring 67 coupled to the inner discharge cover 68 to elastically support the discharge valve 66, an outer discharge cover 69 defining a fluid channel between an inner circumference thereof and the inner discharge cover 68, and a connection pipe 70 mounted to the outer discharge cover 69.

The piston 80 has a fluid suction channel 81 longitudinally defined therein, a suction port 82 formed at a front end thereof to have a smaller diameter than the fluid suction channel 81, and a suction valve 83 mounted to the front end thereof to open or close the suction port 82 depending on a pressure difference between the suction port 82 and the compression chamber C.

As shown in FIG. 3, the piston 80 is formed at a rear end thereof with a flange 84. The flange 84 is used for the connection of the linear motor 100.

A muffler 97 is mounted at a rear side of the piston 80 to guide the fluid, introduced via the suction pipe 71 of the back cover 72, to the fluid suction channel 81 of the piston 80 while attenuating suction noise of the fluid.

The linear motor 100 includes an outer stator core 101 coupled to the cylinder block 64, a bobbin 102 mounted in the outer stator core 101, a coil 103 wound around the bobbin 102, an inner stator core 104 coupled to the cylinder block 64 to be spaced apart from the outer stator core 101 to define a predetermined gap therebetween, a magnet 105 located between the outer stator core 101 and the inner stator core 104 to linearly reciprocate using a magnetic force generated around the coil 103, and a magnet frame 106 configured to support the magnet 105 mounted thereon and coupled to the flange 84 of the piston 80 to transmit the linear movement force of the magnet 105 to the piston 80.

The compression unit 60 includes a motor cover 110 coupled to the outer stator core 101 to cover a rear surface of the outer stator cover 101, and a spring support 116 used to support a first spring 112 interposed between the back cover 72 and the spring support 116 and a second spring 114 interposed between the motor cover 110 and the spring support 116.

Here, the first and second springs 112 and 114 serve to provide the piston 80 with an elastic force to allow the piston 80 to vibrate during reciprocating movement thereof. That is, the first and second springs 112 and 114 temporarily store energy generated in the linear motor 100 to thereby transmit it to the piston 80.

The spring support 116 is fastened to the flange 84 of the piston 80 by means of fastening means, such as bolts.

Meanwhile, the compressor further includes a discharge unit 120 to discharge the compressed fluid from the compression unit 60 to the outside of the shell 50. The discharge unit 120 also serves to attenuate vibration generated in the compression unit 60.

The discharge unit 120 includes a discharge pipe 122 connected to the compression unit 60 to discharge the compressed fluid from the compression unit 60, and a coil weight 130 wound on the discharge pipe 122 to attenuate the vibration of the discharge pipe 122.

The discharge pipe 122 is connected at one end thereof to the compression unit 60, more specifically, the connection pipe 70 of the discharge valve assembly 65. The other end of the discharge pipe 122 is penetrated through the shell 50 to be located at the outside of the shell 50.

As shown in FIG. 5, the discharge pipe 122 is bent by an angle $\alpha$ smaller than 360°. Thus, the discharge pipe 122 according to the embodiment of the present invention has no portion that is coiled up at least two times.

That is, highly vibrational portions 124 and 126 of the discharge pipe 122, which are located at a plane D perpendicular to a vibrating direction C of the compression unit 60, are bent by an angle smaller than 360°. Similarly, the remaining portion of the discharge pipe 122, i.e. low vibrational portion 128 of the discharge pipe 122, is also bent by an angle smaller than 360°.

The coil weight 130 serves to increase the mass of the discharge pipe 122. The coil weight 130 is wound plural times on the highly vibrational portions 124 and 126 of the discharge pipe 122, thereby serving to adjust a natural vibrating frequency of the highly vibrational portions 124 and 126 to a low value.

Specifically, the coil weight 130 is wound at least two times on the highly vibrational portions 124 and 126 of the discharge pipe 122, located at the plane D perpendicular to the vibrating direction C of the compression unit 60, and is also wound only one time on the remaining portion 128 of the discharge pipe 122 except for the highly vibrational portions 124 and 126.

Preferably, the coil weight 130 is wound plural times on part of the discharge pipe 122 that is bent by an angle between 180° and 360°.

Reference numeral 54 denotes a suction pipe through-hole formed at the shell 50 to penetrate the suction pipe 53 through the shell 50.

Reference numeral 55 denotes a discharge pipe through-hole formed at the shell 50 to penetrate the discharge pipe 122 through the shell 50.

Now, the operation of the compressor according to the present invention configured as stated above will be explained.

Upon driving of the linear motor 100, the piston 80 is linearly reciprocated inside the cylinder 62, and the suction valve 83 and the discharge valve 66 are opened or closed depending on a pressure difference caused by the linear reciprocating movement of the piston 80. Thereby, fluid inside the shell 50 is introduced into the compression chamber C to be compressed therein, and then, is discharged to the outside of the shell 50 in a compressed state via the discharge valve assembly 65 and the discharge pipe 122.

Meanwhile, when the piston 80 is retracted, the compression unit 60 is subjected to vibration in a linear reciprocating direction of the piston 80. The vibration of the compression unit 60 acts to the portions 124 and 126 of the discharge pipe 122 located at the plane D perpendicular to the vibrating direction C of the compression unit 60 as compared to the remaining portion 128 of the discharge pipe 122. However, since the highly vibrational portions 124 and 126 located at the plane D perpendicular to the vibrating direction C of the compression unit 60 are increased in mass by virtue of the coil weight 130 wound at least two times thereon, the highly vibrational portions 124 and 126 are reduced in rigidity, resulting in minimized vibration transmission.

As apparent from the above description, the present invention provides a compressor in which a coil weight is wound plural times on highly vibrational portions of a discharge pipe to increase the mass of the highly vibrational portions. With such a configuration, it is possible to adjust a natural vibrating frequency of the discharge pipe to a desired value. Further, since there is no need to coil up the discharge pipe plural times differently from the prior art, the compressor exhibits an effective interior space utility, minimized malfunction rate, and low manufacturing costs.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

The present disclosure relates to subject matter contained in Korean Application No. 10-2004-0088262, filed on Nov. 2, 2004, the contents of which are herein expressly incorporated by reference in its entirety.

What is claimed is:

1. A compressor comprising:

a shell;

a compression unit mounted in the shell, and including a cylinder and a piston which is disposed to linearly reciprocate in the cylinder;

a discharge pipe connected to the compression unit to discharge the compressed fluid from the compression unit; and a coil weight wound on the discharge pipe, wherein the coil weight is wound plural times on a portion of the discharge pipe located at a plane perpendicular to a reciprocating direction of the piston, wherein the portion of the discharge pipe is bent by an angle smaller than 360°, and wherein the coil weight is wound one time on a remaining portion of the discharge pipe.

2. The compressor as set forth in claim 1, wherein the shell is formed with a suction pipe through-hole for the penetration of a fluid suction pipe, and a discharge pipe through-hole for the penetration of the discharge pipe.

3. The compressor as set forth in claim 2, wherein the shell includes:

a lower shell; and an upper shell configured to cover an upper side of the lower shell to thereby define a hermetic space along with the lower shell.

4. The compressor as set forth in claim 1, wherein a rear portion of the compression unit is disposed on a first damper mounted in a front region of the shell, and a front portion of the compression unit is disposed on a second damper mounted in a rear region of the shell, whereby the compression unit is mounted in the shell in a shock-absorbing manner.

5. The compressor as set forth in claim 1, wherein the compression unit further includes:

a cylinder block;

a back cover having a suction pipe;

a suction channel defined inside the piston;

a suction valve to open or close the suction channel;

a discharge valve assembly mounted to define a compression chamber between the piston and the discharge valve assembly and adapted to discharge fluid from the compression chamber into the discharge pipe if the fluid is compressed inside the compression chamber beyond a predetermined pressure;

a linear motor adapted to generate a driving force for linearly reciprocating the piston into the cylinder;

a motor cover coupled to a side of the linear motor; and a spring support configured to support a first spring interposed between the back cover and the spring support and a second spring interposed between the motor cover and the spring support.

6. The compressor as set forth in claim 5, wherein the discharge valve assembly includes:

a discharge valve to open or close a front end of the cylinder;

an inner discharge cover having a fluid discharge hole formed at one side thereof;

a discharge spring coupled to the inner discharge cover to elastically support the discharge valve;

an outer discharge cover defining a fluid channel between an inner circumference thereof and the inner discharge cover; and a connection pipe mounted to the outer discharge cover to be connected to the discharge pipe.

7. The compressor as set forth in claim 5, wherein the linear motor includes:

an outer stator core coupled to the cylinder block;

a bobbin mounted in the outer stator core;

a coil wound around the bobbin;

an inner stator core coupled to the cylinder block to be spaced apart from the outer stator core to define a predetermined gap therebetween;

a magnet located between the outer stator core and the inner stator core to linearly reciprocate using a magnetic force generated around the coil; and a magnet frame configured to support the magnet mounted thereon and coupled to the piston to transmit linear movement force of the magnet to the piston.

8. The compressor as set forth in claim 1, wherein a plurality of portions of the discharge pipe are located at the plane perpendicular to the reciprocating direction of the piston.

9. The compressor as set forth in claim 1, wherein the coil weight is wound plural times on the portion of the discharge pipe that is bent by an angle between 180°and 360°.

10. The compressor as set forth in claim 1, wherein the coil weight is wound one time on the remaining portion of the discharge pipe except for the portion of the discharge pipe located at the plane perpendicular to the-reciprocating direction of the piston.

* * * * *